US006648547B2

(12) United States Patent
Jones et al.

(10) Patent No.: US 6,648,547 B2
(45) Date of Patent: Nov. 18, 2003

(54) METHOD OF REINFORCING AND WATERPROOFING A PAVED SURFACE

(75) Inventors: David R. Jones, Tampa, FL (US); Gregory S. Helwig, Granville, OH (US); John D. Sintich, Aiken, SC (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 57 days.

(21) Appl. No.: 09/795,774

(22) Filed: Feb. 28, 2001

(65) Prior Publication Data

US 2002/0159837 A1 Oct. 31, 2002

(51) Int. Cl.[7] ..... E01C 3/06
(52) U.S. Cl. ..... 404/31; 404/70
(58) Field of Search ..... 404/31, 45, 70, 404/71, 82, 17, 27, 36

(56) References Cited

U.S. PATENT DOCUMENTS

| | | | | |
|---|---|---|---|---|
| 2,115,667 A | | 4/1938 | Ellis | |
| 3,311,035 A | | 3/1967 | Poskey et al. | |
| 3,557,671 A | | 1/1971 | Vasiloff | |
| 3,856,732 A | | 12/1974 | Bresson et al. | |
| 3,931,439 A | * | 1/1976 | Bresson et al. | 428/265 |
| 3,932,051 A | | 1/1976 | Cleary | |
| 4,074,948 A | | 2/1978 | Heater, Jr. | |
| 4,151,025 A | | 4/1979 | Jacobs | |
| 4,175,978 A | | 11/1979 | Marzocchi et al. | |
| 4,259,127 A | | 3/1981 | Schachter | |
| 4,319,854 A | | 3/1982 | Marzocchi | |
| 4,359,546 A | | 11/1982 | Bershas | |
| 4,362,780 A | * | 12/1982 | Marzocchi et al. | 428/283 |
| 4,404,244 A | | 9/1983 | Springston | |
| 4,508,770 A | | 4/1985 | Muncaster et al. | |
| 4,540,311 A | | 9/1985 | Leach | |
| 4,629,358 A | | 12/1986 | Springston et al. | |
| 4,637,946 A | | 1/1987 | Shah et al. | |

(List continued on next page.)

FOREIGN PATENT DOCUMENTS

| | | |
|---|---|---|
| FR | 2 767 543 | 2/1999 |
| FR | 2 777 577 | 10/1999 |
| JP | 406 248 609 | 9/1994 |
| JP | 406 346 405 | 12/1994 |
| JP | 408 013 408 | 1/1996 |
| JP | 02000 027109 | 1/2000 |
| JP | 02001 234505 | 8/2001 |
| WO | WO 00/61850 | 10/2000 |

OTHER PUBLICATIONS

TC Mirafi—Technical Data Sheet—Mirafi Mirapave400.
S. F. Brown & N. H. Thom, Association of Asphalt Paving Technologists 2001 Annual Meeting, A study of grid reinforced asphalt to combat reflection cracking,.
The Amoco Petromat System, Installation, pp. 1–2, (Jan. 7, 2001).
The Amoco Petromat System, Introduction, p. 1, (Jan. 7, 2001).
The Amoco Petromat System, Other Considerations, p. 1, (Jan. 7, 2001).
The Amoco Petromat system, Benefits, p. 1, (Jan. 7, 2001).

*Primary Examiner*—Robert E. Pezzuto
*Assistant Examiner*—Raymond W Addie
(74) *Attorney, Agent, or Firm*—Inger H. Eckert; James J. Dottavio

(57) ABSTRACT

In a method of reinforcing and waterproofing a paved surface, a layer of liquefied asphalt is applied on a paved surface. A reinforcement mat is applied over the liquefied asphalt. The reinforcement mat is a nonwoven mat produced from fibers having a melting point above about 320° F. (160° C.), and selected from mineral fibers such as glass fibers, polymer fibers, or mixtures thereof. The liquefied asphalt penetrates and soaks the reinforcement mat to form a water barrier. A layer of paving material is applied over the reinforcement mat.

6 Claims, 1 Drawing Sheet

U.S. PATENT DOCUMENTS 4,649,169 A * 3/1987 Thompson et al. ..... 524/247
4,699,542 A 10/1987 Shoesmith
4,834,577 A 5/1989 Perfetti
4,856,930 A 8/1989 Denning
4,957,390 A 9/1990 Shoesmith
5,026,609 A 6/1991 Jacob et al.
5,110,627 A 5/1992 Shoesmith et al.
5,246,306 A 9/1993 Shoesmith et al.
5,393,559 A 2/1995 Shoesmith et al.
5,521,305 A 5/1996 Huber et al.
5,711,834 A 1/1998 Saito
5,804,003 A * 9/1998 Nishizawa ..... 156/42
5,836,715 A 11/1998 Hendrix et al.
5,897,946 A * 4/1999 Nachtman et al. ..... 428/323
5,941,656 A 8/1999 Sugiyama et al.
5,955,386 A * 9/1999 Horton ..... 442/138
6,123,879 A 9/2000 Hendrix et al.
6,235,136 B1 5/2001 Kittson et al.

* cited by examiner

METHOD OF REINFORCING AND WATERPROOFING A PAVED SURFACE

TECHNICAL FIELD AND INDUSTRIAL APPLICABILITY OF THE INVENTION

The present invention is related generally to methods of reinforcing and waterproofing paved surfaces such as roads and parking lots, and more particularly to a method which includes the use of a reinforcement mat.

BACKGROUND OF THE INVENTION

Paved surfaces such as roads and parking lots are commonly constructed with a top surface layer of asphalt paving material. Over a period of time, the paved surface usually deteriorates due to the effects of traffic, temperature cycles and other environmental causes. Cracks develop in the paved surface, and the cracks can spread and cause further deterioration. Water can penetrate the paved surface by flowing into the cracks, causing further damage.

Damaged paved surfaces are usually repaired by applying a new surface layer of paving material over the damaged portions or over the entire paved surface. After a paved surface having cracks is resurfaced, many times the new surface layer cracks directly over the cracks in the old surface. This is known as "reflective cracking". One way to address this problem is to make the new surface layer thicker, but this is not very effective.

Consequently, various reinforcement materials and methods have been tried for preventing or repairing cracks and other deterioration in paved surfaces. One commercial product (an example of which is Petromat® available from BP Amoco) is a reinforcement mat constructed from polypropylene fibers. The polypropylene mat is applied over a tack coat of asphalt, and then a surface layer of paving material is applied over the mat. The paving material is heated prior to its application over the mat. Unfortunately, the polypropylene mat tends to melt and/or shrink when it is exposed to the hot paving material, which detracts from its ability to provide reinforcement and waterproofing. Additionally, if the tack coat is applied at too high a temperature, the polypropylene mat may likewise shrink or melt.

Another commercial product consists of glass fiber rovings attached to a nonwoven felt. This product and other laminated products are relatively difficult and expensive to manufacture. A laminated product may also experience separation between the layers, which could create a slip plane causing the paved surface to come apart. Also, a cellulosic felt is not as strong as a fibrous mat.

Various patents describe reinforcement materials and methods of reinforcing paved surfaces. For example, U.S. Pat. No. 2,115,667 to Ellis discloses reinforcing an asphalt road with a reinforcing agent made from woven glass. A woven reinforcement material is usually less porous than a nonwoven material. This impedes the ability of the asphalt to penetrate the reinforcement material to create a strong paved surface. A woven material is also usually more expensive to manufacture than a nonwoven material.

U.S. Pat. No. 4,637,946 to Shah et al. discloses a road repair membrane comprising a glass fiber mat impregnated with a blend of asphalt, block copolymer and mineral filler. An impregnated mat would not be very effective in soaking up asphalt to create a strong bond with the road. A weakly bonded mat could delaminate from the asphalt layers, enabling the road surface to come apart.

In view of the above, it would be desirable to provide an improved method of reinforcing and waterproofing a paved surface, including a method of repairing a defect such as a crack in the paved surface.

SUMMARY OF THE INVENTION

The above object as well as others not specifically enumerated are achieved by a method of reinforcing and waterproofing a paved surface according to the invention. Initially, a layer of liquefied asphalt is applied on a paved surface. A reinforcement mat is then applied over the liquefied asphalt. The reinforcement mat comprises a nonwoven mat produced from fibers having a melting point above about 320° F. (160° C.). The fibers are selected from the group consisting of mineral fibers, such as glass fibers; or polymer fibers, and mixtures of mineral and polymer fibers. The liquefied asphalt penetrates and soaks the reinforcement mat to form a water barrier. A layer of paving material is then applied over the reinforcement mat.

In another embodiment of the method, a layer of liquefied asphalt is applied on a paved surface. A reinforcement mat is then applied over the liquefied asphalt. The reinforcement mat comprises a nonwoven mat produced from fibers selected from the group consisting of mineral fibers and a mixture of mineral fibers and polymer fibers. The liquefied asphalt penetrates and soaks the reinforcement mat to form a water barrier. A layer of paving material is then applied over the reinforcement mat.

Another embodiment of the method relates to repairing a crack in a paved surface. A reinforcement mat is applied over the crack by securing the reinforcement mat to the paved surface on one side of the crack, and leaving the reinforcement mat unsecured to the paved surface on the opposite side of the crack. In a preferred embodiment of the repair method, the reinforcement mat comprises a nonwoven mat produced from fibers selected from the group consisting of mineral fibers such as glass fibers; or polymer fibers, and mixtures of mineral and polymer fibers. A layer of paving material is then applied over the reinforcement mat.

Various objects and advantages of this invention will become apparent to those skilled in the art from the following detailed description of the preferred embodiments, when read in light of the accompanying drawings.

DETAILED DESCRIPTION AND PREFERRED EMBODIMENTS OF THE INVENTION

The present invention relates to an improved method of reinforcing and waterproofing a paved surface such as a road, a parking lot, or any other type of paved surface. The method can be used in the construction of a new paved surface, in the rejuvenation of an existing paved surface, or to repair a crack, pothole or other defect in an existing paved surface.

Figure 1:
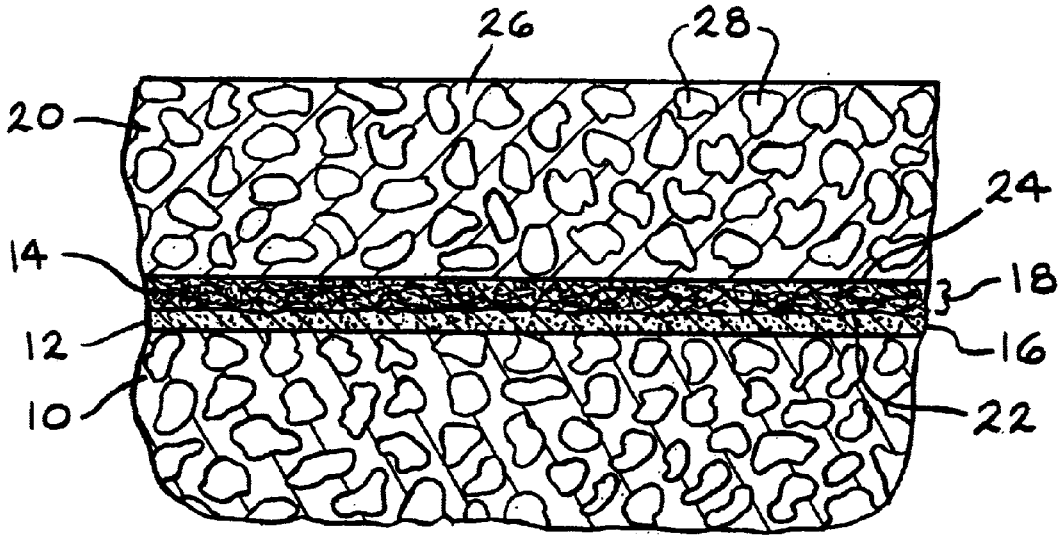
FIG. 1 is a cross-sectional view of a paved surface which is reinforced and waterproofed according to the method of the invention.

Referring now to the drawings, FIG. 1 shows a paved surface 10 which is reinforced and waterproofed according to the method of the invention. A first step of the method is to apply a layer of liquefied asphalt 12 on the paved surface 10. The liquefied asphalt 12 can be any type of bituminous material which is fluid at the time of application but which is able to firm up after application. For example, the liquefied asphalt can be a molten asphalt (e.g., asphalt heated to a temperature above about 250° F. [121° C.]), an asphalt emulsion (asphalt dispersed in water with an emulsifier), or an asphalt cutback (asphalt diluted with a solvent to make the asphalt fluid).

The layer of liquefied asphalt 12 can be applied in any amount which is suitable for penetrating and soaking the reinforcement mat 14 (described below). Preferably, the liquefied asphalt is applied at a rate within a range of from about 0.1 gallon/square yard (0.32 liter/square meter) to about 0.5 gallon/square yard (1.58 liter/square meter), the optimum rate depending on the weight of the reinforcement mat. The liquefied asphalt can be applied by any suitable method, such as by spraying it as a layer or by pouring and spreading it into a layer.

A second step of the method is to apply the reinforcement mat 14 over the liquefied asphalt 12, while the liquefied asphalt is still in the fluid condition. The reinforcement mat is sufficiently porous such that the liquefied asphalt penetrates and soaks the reinforcement mat. In the embodiment shown, the layer of liquefied asphalt 12 includes a bottom portion 16 below the reinforcement mat 14 and a top portion 18 which saturates the reinforcement mat. However, the liquefied asphalt could also be located entirely inside the reinforcement mat after it is applied. Preferably, the reinforcement mat can soak up at least about 0.1 gallon/square yard (0.32 liter/square meter) of the liquefied asphalt.

A sufficient amount of liquefied asphalt 12 is applied, and the reinforcement mat 14 soaks up enough liquefied asphalt, to form a strong bond with the paved surface 10 and with the layer of paving material 20 (described below), and to form a water barrier which prevents water from penetrating into the paved surface from above. Preferably, the reinforcement mat is substantially completely saturated with the liquefied asphalt, such that the liquefied asphalt penetrates from the bottom 22 to the top 24 of the reinforcement mat 14.

The reinforcement mat 14 is a nonwoven fibrous mat made from mineral fibers such as glass fibers; or polymer fibers, or mixtures of mineral fibers and polymer fibers. The nonwoven mat is usually more porous and less expensive to manufacture than a woven mat. Preferably, the reinforcement mat is not impregnated with any materials, such as asphalt, polymer or filler, prior to its application over the liquefied asphalt. An impregnated mat would not be as effective in soaking up the liquefied asphalt to create a strong bond with the paved surface and the layer of paving material. Also preferably, the reinforcement mat is not laminated with another layer of material. A non-laminated mat avoids the possible separation and the added expense of a laminated product.

Suitable mineral fibers for producing the reinforcement mat include fibers of a heat-softenable mineral material, such as glass, rock, slag or basalt. Preferably, the mineral fibers are glass fibers. Any suitable process can be used to produce the glass fibers. One such process is known as a rotary process, in which molten glass is placed into a rotating spinner which has orifices in the perimeter, wherein glass flows out the orifices to produce a downwardly falling stream of fibers which are collected on a conveyor. A second fiber forming process is a continuous process in which glass fibers are mechanically pulled from the orificed bottom wall of a feeder or bushing containing molten glass. Substantially contemporaneous with forming, the glass fibers are brought into contact with an applicator wherein a size is applied to the fibers. The sized glass fibers are then chopped to a specified length and packaged. Glass fibers made by these processes are commercially available from Owens Corning, Toledo, Ohio. In one embodiment, the reinforcement mat is an OCMat 9003 glass mat commercially available from Owens Coming. This mat contains glass fibers that are 16 micron diameter E-glass type 9501. The mat contains 18% binder consisting of urea-formaldehyde resin and styrene-butadiene latex. Alternative glass mats can also be used.

Suitable polymer fibers for producing the reinforcement mat can be formed from a fibrous or fiberizable material prepared from natural organic polymers, synthetic organic polymers or inorganic substances. Natural organic polymers include regenerated or derivative organic polymers. Synthetic polymers include, but are not limited to, polyesters such as polyethylene terephthalate (PET), polyamides (e.g., nylons), polypropylenes, polyphenylenes such as polyphenylene sulfide (PPS), polyolefins, polyurethanes, polycarbonates, polystyrenes, acrylics, vinyl polymers, and derivatives and mixtures thereof. Preferably, the polymer fibers have a melting point greater than about 320° F. (160° C.), so that the reinforcement mat does not melt or shrink when it is exposed to hot paving material. One skilled in the art appreciates that the polymer fiber content of the reinforcement mat may be varied to achieve the desired properties, and as such the content may include about 1% by weight to about 99% by weight polymer fibers. Preferably, the polymer fibers include at least about 5% by weight polyester fibers, at least about 5% by weight nylon fibers, or at least about 5% by weight of a mixture of polyester fibers and nylon fibers. Nylon fibers are preferred for use in the reinforcement mat because of their high melting point (509° F. [265° C.]). Nylon or PET fibers preferably have a denier within a range between about 1.5 dtex and about 12 dtex, and preferably have a cut length within a range between about 0.25 inch (0.64 cm) and about 2 inches (5.08 cm).

In a preferred embodiment of the invention, the polymer fibers are reclaimed fibers, scrap fibers, or mixtures thereof. The use of reclaimed or scrap fibers is economical and good for the environment. The reclaimed polymer fibers can be any type of reclaimed fibers suitable for producing a reinforcement mat having the desired properties. In one embodiment, the reclaimed polymer fibers are reclaimed carpet fibers. It is estimated that up to 3 billion pounds (1.36 billion kilograms) of carpet are discarded every year in the United States alone. The carpet fibers can be made from any fiber-forming polymer suitable for textile applications, including, but not limited to, polyamides such as nylons (e.g., nylon 6, nylon 6,6, and nylon 6,12), polyesters, polypropylenes, polyethylenes, poly(trimethylene terephthalate), poly(ethylene terephthalate), ethylene-vinyl acetate copolymer, and acrylics. Non-limiting examples of useful polyamide fibers include nylon fibers such as are commercially available from E. I. duPont de Nemours and Company of Wilmington, Del., polyhexamethylene adipamide, polyamide-imides and aramids.

The scrap polymer fibers can be any type of scrap fibers suitable for producing a reinforcement mat having the desired properties. The scrap fibers can be any consumer or industrial scrap fibers. In one embodiment, the scrap fibers are scrap carpet fibers, such as cut ends, bobbin ends, fibers generated from edge trimming, or fibers which do not meet manufacturing specifications.

In a preferred embodiment, the fibers used to produce the reinforcement mat are a mixture of glass fibers and polymer fibers (each preferably having a melting point greater than about 320° F. [160° C.]). The addition of the polymer fibers increases the flexibility, resilience and ease of handling of the reinforcement mat, while the addition of the glass fibers increases the tensile strength and reduces the elongation of the reinforcement mat. The combination produces a strong and flexible mat which is easy to handle.

For example, a preferred reinforcement mat according to the invention is produced from a mixture of 70% by weight glass fibers and 30% by weight PET fibers. In a preferred embodiment, the glass fibers are 16 micron diameter E-glass type 9501, and the PET fibers have a denier between about 1.5 dtex and about 12 dtex and a cut length between about 0.25 inch (0.64 cm) and about 2 inches (5.08 cm). Such a mat weighing 4 ounces per square yard has the following physical properties:

| | | | Typical Value | |
|---|---|---|---|---|
| Property | Test method | Units | MD | CD |
| Grab tensile strength | ASTM D4632 | N (lb) | 300 (67) | 190 (44) |
| Grab tensile elongation | ASTM D4632 | % | 2.3 | 1.8 |
| Trapezoidal tear strength | ASTM D4532 | N (lb) | 24 (5.4) | 24 (5.4) |
| Mullen burst strength | ASTM D3786 | kPa (psi) | 485 (70) | |
| Melting point | ASTM D276 | ° C.(° F.) | >230 (>450) | |
| Asphalt absorption | Tex-616-J | $l/m^2(gal/yd^2)$ | 0.66 (0.21) | |
| Shrinkage | Tex-616-J | % | 0 | |
| Mass per unit area | ASTM D5261 | $g/m^2(oz/yd^2)$ | 136 (4.0) | |

The reinforcement mat of the invention can be produced by any suitable method which produces a nonwoven fibrous mat. Preferably, the reinforcement mat is produced by a wet-laid process. In this process, a water slurry is provided into which the fibers are dispersed. The water slurry may contain surfactants, viscosity modifiers, defoaming agents, or other chemical agents. Chopped fibers are then introduced into the slurry and agitated such that the fibers become dispersed. The slurry containing the fibers is then deposited onto a moving screen, and a substantial portion of the water is removed to form a web. A binder is then applied, and the resulting mat is dried to remove the remaining water and to cure the binder. The resulting nonwoven mat consists of an assembly of substantially dispersed individual fibers. The nonwoven mat can also be produced by a dry-laid process. In this process, fibers are chopped and air blown onto a conveyor, and a binder is then applied to form the mat.

In another preferred embodiment, the reinforcement mat is made of glass fibers. A glass fiber mat is thermally stable, and does not melt and/or shrink when it is exposed to hot paving material. The glass fiber mat has much higher tensile and mechanical strengths than the polypropylene mats typically used. Preferably, the glass fiber mat has a density within a range of from about 0.5 to about 10 pounds per hundred square feet (about 0.02 $kg/m^2$ to about 0.42 $kg/m^2$), and more preferably from about 1 to about 5 pounds per hundred square feet (about 0.04 $kg/m^2$ to about 0.21 $kg/m^2$). In a specific embodiment, the reinforcement mat is a glass fiber mat suitable for use as a roll roofing product, except that it is not saturated with asphalt before application. For example, the reinforcement mat may be wrapped in a continuous roll having a width within a range of from about 10 feet (3.05 meters) to about 20 feet (6.1 meters). The reinforcement mat is applied over the liquefied asphalt by unrolling the reinforcement mat from the roll onto the liquefied asphalt.

The liquefied asphalt is allowed to firm up (at least partially solidify) at some time after the application of the reinforcement mat. Usually, it is allowed to firm up before the application of the paving material described below. For example, the molten asphalt is allowed to firm up by cooling, the asphalt emulsion is allowed to firm up by the evaporation of water, or the cutback asphalt is allowed to firm up by the evaporation of solvent. The open porosity of the reinforcement mat facilitates the evaporation of water or solvent.

A third step of the method is to apply a layer of paving material 20 over the reinforcement mat 14. The paving material 20 can be any material suitable for providing a top surface layer of a paved surface, such as an asphalt paving material (a mixture of asphalt 26 and aggregate 28) or a concrete paving material. The paving material is usually applied in a heated condition, and then allowed to cool.

When the reinforcement of the paved surface is completed, the penetration of the reinforcement mat by the liquefied asphalt 12 (now at least partially solidified) forms a strong bond between the reinforcement mat 14, the asphalt 12, the paved surface 10 and the layer of paving material 20. This creates a strong, monolithic paved surface structure which is very resistant to damage. The high tensile and mechanical strength of the reinforcement mat provides mechanical reinforcement to the paved surface. Additionally, the penetration of the reinforcement mat by the asphalt forms a water barrier or waterproof membrane that prevents water from penetrating into the paved surface from above and causing damage.

In one embodiment of the invention, the method comprises pavement of a non-paved surface by applying the liquefied asphalt on a prepared unpaved surface, applying the reinforcement mat over the liquefied asphalt and the prepared unpaved surface, and applying the paving material over the reinforcement mat.

As mentioned above, the method of the invention can be used in the construction of a new paved surface, in the rejuvenation of an existing paved surface, or to repair a crack, pothole or other defect in an existing paved surface. When repairing a defect in a paved surface, a first step of the method is to apply a layer of liquefied asphalt on a paved surface having a defect. When the defect is a crack in the paved surface, the liquefied asphalt may be applied over the crack without initial preparation of the crack, or alternatively the crack may be filled with an appropriate crack filler such as those meeting the requirements of ASTM D-3405 or D-1190 or other suitable material. When the defect is a pothole in the paved surface, usually the pothole is initially filled with a material conventionally used for filling potholes, such as an asphalt paving material. Then the liquefied asphalt is applied over the filled pothole. Badly broken or rough pavement may require milling or placement of a leveling course before application of the liquefied asphalt. The reinforcement mat is then applied over the liquefied asphalt and the defect. Finally, a layer of paving material is applied over the reinforcement mat and the defect. When the repair is completed, the reinforcement mat holds the paved surface around the defect together, and the mat/asphalt waterproof membrane prevents water from penetrating into the defect from above and causing further damage.

In another embodiment, the invention relates to a preferred method of repairing a crack in a paved surface. FIG.

Figure 2:
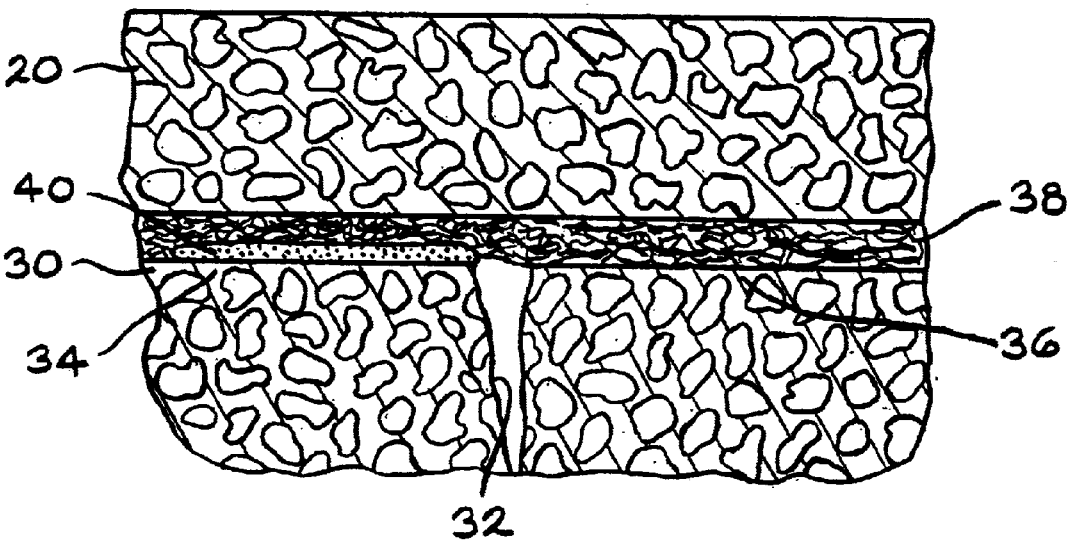
FIG. 2 is a cross-sectional view of a paved surface having a crack which is repaired according to the method of the invention.

2 shows a paved surface 30 having a crack 32 which is repaired according to this method. The paved surface 30 includes a first surface portion 34 on one side of the crack (the left side in FIG. 2), and a second surface portion 36 on the opposite side of the crack (the right side in FIG. 2). In the illustrated embodiment, the first surface portion is adjacent a first longitudinal side of the crack and the second surface portion is adjacent a second longitudinal side of the crack.

In this repair method, a reinforcement mat 38 is applied over the crack 30. Preferably, the reinforcement mat 38 is a nonwoven mat produced from mineral fibers, polymer fibers, or mixtures of mineral and polymer fibers. However, other types of reinforcement mats can also be used in this embodiment of the invention. Unlike the first embodiment of the invention, in this repair method it is preferred that the reinforcement mat is saturated with asphalt before it is applied. The reinforcement mat 38 is secured to the first surface portion 34 of the paved surface on the one side of the crack, but it is left unsecured to the second surface portion 36 of the paved surface on the opposite side of the crack. Then, a layer of paving material 20 is applied over the reinforcement mat. Securing the reinforcement mat to the paved surface on only one side of the crack reduces the occurrence of reflective cracking by leaving a slip plane between the reinforcement mat 38 and the second surface portion 36 of the paved surface. The slip plane allows some movement of the paved surface surrounding the crack over time, without that movement being reflected to the newly applied layer of paving material and creating a crack in the paving material.

The reinforcement mat can be secured to the paved surface on one side of the crack by any suitable method. In one embodiment (shown in FIG. 2), an adhesive 40 is applied to the first surface portion 34 of the paved surface adjacent the crack 32 and the reinforcement mat 38 is adhered to the adhesive. Any suitable adhesive can be used, such as molten asphalt or a polymeric adhesive. In another embodiment (not shown), the adhesive is applied to the reinforcement mat, and the reinforcement mat having the adhesive is then applied to the paved surface. In another embodiment (not shown), the reinforcement mat is secured to the paved surface by applying a pressure sensitive adhesive to the reinforcement mat, and then pressing the reinforcement mat against the paved surface. In a further embodiment (not shown), the reinforcement mat is secured to the paved surface by applying a self-activated adhesive to the reinforcement mat, and applying the reinforcement mat to the paved surface in a manner which activates the adhesive. For example, the self-activated adhesive may be a heat-activated adhesive which is activated when the layer of heated paving material is applied over the reinforcement mat. Alternatively, the reinforcement mat may comprise other known materials adhered to a single side of the crack.

The principle and mode of operation of this invention have been described in its preferred embodiments. However, it should be noted that this invention may be practiced otherwise than as specifically illustrated and described without departing from its scope. For example, while the method of the invention has been illustrated in terms of reinforcing a new or rejuvenated paved surface, and repairing a crack in a paved surface, the method can also be used for repairing other defects such as potholes in paved surfaces. The drawings show a particular type and size of reinforcement mat, but other types and sizes of mat can also be used. The drawings also show particular types and amounts of liquefied asphalt and paving material, but it is recognized that other types and amounts can be used in the invention.

What is claimed is:

1. A method of reinforcing and waterproofing a paved surface comprising the steps of:

applying a layer of liquefied asphalt on a surface;

forming a water barrier by applying a non-laminated reinforcement mat over the liquefied asphalt, the reinforcement mat comprising a nonwoven mat produced from a mixture of mineral fibers and polymer fibers, the fibers having a melting point above about 320° F. (160° C.) wherein the reinforcement mat is not impregnated prior to its application over the liquefied asphalt, and wherein the liquefied asphalt penetrates and soaks the reinforcement mat to form the water barrier; and applying a layer of paving material over the reinforcement mat.

2. A method according to claim 1 wherein the liquefied asphalt penetrates from a bottom to a top of the reinforcement mat.

3. A method according to claim 1 wherein the polymer fibers are selected from the group consisting of reclaimed fibers, scrap fibers, and mixtures thereof.

4. A method according to claim 1 wherein the fibers include at least about 5% by weight nylon fibers.

5. A method according to claim 1 wherein the method comprises pavement of a non-paved surface by applying the liquefied asphalt on a prepared unpaved surface, applying the reinforcement mat over the liquefied asphalt and the prepared unpaved surface, and applying the paving material over the reinforcement mat.

6. A method according to claim 1 wherein the mineral fibers are glass fibers.

* * * * *